US010066536B2

(12) United States Patent
Yamamoto

(10) Patent No.: US 10,066,536 B2
(45) Date of Patent: Sep. 4, 2018

(54) VEHICLE EXHAUST DEVICE

(71) Applicant: KAWASAKI JUKOGYO KABUSHIKI KAISHA, Hyogo (JP)

(72) Inventor: Shigeki Yamamoto, Akashi (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 0 days.

(21) Appl. No.: 15/332,167

(22) Filed: Oct. 24, 2016

(65) Prior Publication Data

US 2017/0184005 A1 Jun. 29, 2017

(30) Foreign Application Priority Data

Dec. 28, 2015 (JP) ..... 2015-255651

(51) Int. Cl.
*F01N 13/10* (2010.01)
*F01N 13/00* (2010.01)

(52) U.S. Cl.
CPC ..... *F01N 13/008* (2013.01); *F01N 13/10* (2013.01)

(58) Field of Classification Search
CPC ..... F01N 13/008; F01N 2340/04; F01N 2590/04; F02B 77/086
See application file for complete search history.

(56) References Cited

U.S. PATENT DOCUMENTS

2006/0283180 A1 12/2006 Hiraga
2008/0236152 A1* 10/2008 Morita ..... F01N 3/10 60/324
2013/0220724 A1* 8/2013 Yazaki ..... B62J 23/00 180/309
2017/0183994 A1* 6/2017 Nakata ..... B62M 7/02

FOREIGN PATENT DOCUMENTS

JP 4568644 10/2010

* cited by examiner

*Primary Examiner* — Jonathan Matthias
(74) *Attorney, Agent, or Firm* — Wenderoth, Lind & Ponack, L.L.P.

(57) ABSTRACT

The vehicle exhaust device has an exhaust passage from an exhaust port of an engine body to an exhaust muffler provided behind the engine body, and the exhaust passage is formed by a plurality of exhaust passage forming units. The exhaust device includes an exhaust gas sensor attached to one of the exhaust passage forming units, such as a collecting pipe, halfway on the exhaust passage. At least a portion of the exhaust gas sensor is covered from a front side thereof with one of the exhaust passage forming units, such as an individual exhaust pipe, upstream of an attached position of the exhaust gas sensor.

17 Claims, 9 Drawing Sheets

VEHICLE EXHAUST DEVICE

BACKGROUND OF THE INVENTION

Field of the Invention

The present invention relates to a vehicle exhaust device, and particularly relates to an exhaust device including an exhaust gas sensor configured to detect a property such as a concentration of oxygen in exhaust gas.

Description of the Related Art

JP 4568644 B1 exemplifies a conventional technique on an exhaust device including an exhaust gas sensor. The exhaust device disclosed in JP 4568644 B1 is mounted on a motorcycle as depicted in FIG. 9. The exhaust device includes two exhaust pipes 202 that are connected respectively to exhaust ports of a two-cylinder engine and that extend downward in a front space of an engine body E, and a collecting pipe 203 to which the exhaust pipes 202 are collected below the engine body E. The collecting pipe 203 has a rear end connected with a front end inlet pipe 204*a* of an exhaust muffler 204. The inlet pipe 204*a* is provided with an exhaust gas component sensor 205. The exhaust muffler 204 includes a case accommodating an exhaust gas introduction pipe and a catalyst pipe connected to the exhaust gas introduction pipe. The exhaust gas introduction pipe extends backward from the inlet pipe 204*a* and curves in a U shape in a rear portion in the muffler case. The exhaust gas component sensor 205 is disposed to protrude outward from an outer peripheral surface of the exhaust muffler inlet pipe 204*a*. There is provided no full cowl or the like covering front, side, and bottom ends of the exhaust device.

In the exhaust device according to JP 4568644 B1, the protrusion of the exhaust gas component sensor 205 may collide with foreign matter like sand, mud, or pebbles raised during travel depending on a travel condition. Such foreign matter will dirty or hurt the exhaust gas component sensor 205.

SUMMARY OF THE INVENTION

It is an object of the present invention to provide a vehicle exhaust device configured to protect an exhaust gas sensor attached thereto from foreign matter like mud or sand raised in front without any dedicated protective member such as a cowl provided in front of the exhaust device.

In order to achieve the object mentioned above, the present invention provides a vehicle exhaust device having an exhaust passage from at least one exhaust port provided at an engine body to an exhaust muffler provided behind the engine body, the exhaust passage being formed by a plurality of exhaust passage forming units, the exhaust device including: an exhaust gas sensor attached to a portion of the exhaust passage forming units halfway on the exhaust passage; in which at least a portion of the exhaust gas sensor is covered from a front side thereof with the portion of the exhaust passage forming units upstream of an attached position of the exhaust gas sensor.

According to the present invention, the portion of the exhaust passage forming units positioned in front of the exhaust gas sensor prevents collision with the exhaust gas sensor, of foreign matter raised from a road surface in front of the vehicle during travel. The exhaust gas sensor is protected from collision with foreign matter flying from ahead without provision of any dedicated member such as a cowl covering the front end of the exhaust device. This configuration also achieves reduction in the number of parts. Furthermore, there is no need to consider foreign matter raised from a road surface as to positioning of the exhaust gas sensor, which accordingly has enhanced disposition flexibility.

The present invention is preferred to optionally have any of the following configurations, in addition to the above features.

(a) The engine body includes a plurality of cylinders, the plurality of exhaust passage forming units includes a plurality of individual exhaust pipes connected respectively to the exhaust ports of the cylinders and a collecting pipe collecting downstream ends of the plurality of individual exhaust pipes, and the exhaust gas sensor is attached to the collecting pipe.

In this configuration, the exhaust gas sensor in a multiple cylinder engine is attached to the collecting pipe provided separately from the plurality of individual exhaust pipes. This configuration thus facilitates processing of a sensor attachment portion.

(b) In addition to the configuration (a), the two individual exhaust pipes have downstream connections disposed in parallel with each other, and the exhaust gas sensor is positioned between the two connections when viewed in a direction perpendicular to a plane including axial lines of the connections.

In this configuration, the two individual exhaust pipes easily cover the exhaust gas sensor, which is also protected from raised foreign matter in a wider range. In particular, this configuration protects the exhaust gas sensor more effectively from foreign matter flying laterally.

(c) In addition to the configuration (a) or (b), the collecting pipe has a front end connected to lower ends of the individual exhaust pipes and positioned above the attached position of the exhaust gas sensor.

This configuration efficiently prevents collision of foreign matter with a root portion of the exhaust gas sensor. Specifically, the front end of the collecting pipe is positioned higher than the attachment portion (root portion) of the exhaust gas sensor, so as to have less opportunity of contact of foreign matter flying anteroposteriorly with the lower end of the exhaust gas sensor.

(d) In addition to any one of the configurations (a) to (c), the collecting pipe includes a downstream rear portion disposed close to a lower front end of the engine body and provided anteroposteriorly, a curved portion connected to a front end of the rear portion and curved upward, and an upstream front portion extending from an upper end of the curved portion to the lower ends of the individual exhaust pipes.

In this configuration, the front portion of the collecting pipe and the connections at the lower ends of the individual exhaust pipes are easily disposed in front of the exhaust gas sensor, the front end of which is thus covered easily. The exhaust gas sensor is easily covered from the front side thereof particularly in a case where a rising portion of the curved portion is positioned in front of the attachment portion of the exhaust gas sensor.

(e) In addition to any one of the configurations (a) to (d), the exhaust gas sensor protrudes radially outward from the collecting pipe, the downstream connections of the individual exhaust pipes covering the exhaust gas sensor from the front side thereof extend in an extending direction of the exhaust gas sensor in a front view.

In this configuration, the outward protrusion of the exhaust gas sensor is covered while areas of the individual exhaust pipes are utilized efficiently. The areas in a front view of the individual exhaust pipes are efficiently utilized to cover the protrusion particularly in order to prevent collision of foreign matter from ahead (a front side).

(f) In addition to any one of the configurations (a) to (e), the collecting pipe is disposed at a position deviating to one side in a vehicle width direction from a center in the vehicle width direction, and the outward protrusion of the exhaust gas sensor slants outward in the vehicle width direction toward an upper end.

The exhaust gas sensor is easily disposed along the outer peripheral surface of the engine in this configuration. The exhaust gas sensor does not bulge largely from the outer peripheral surface of the engine and has less opportunity of contact with any other colliding object. The exhaust gas sensor is prevented from interfering with a protrusion of an oil filter or the like provided to protrude forward from a front surface of the engine body.

(g) In addition to any one of the configurations (a) to (f), the exhaust gas sensor is disposed in front of the engine body, and the rear portion of the collecting pipe is disposed below the engine body.

This configuration prevents interference between the exhaust gas sensor and the engine body, and the exhaust gas sensor is easily disposed close to the engine body. This configuration allows the exhaust gas sensor to be disposed close to the engine body and thus reduces opportunity of contact with any colliding object.

(h) In addition to any one of the configurations (a) to (g), the vehicle exhaust device further includes a guard covering the exhaust gas sensor from a lateral side thereof in the vehicle width direction.

This configuration prevents collision with foreign matter flying laterally in the vehicle width direction.

(i) In addition to any one of the configurations (a) to (h), the individual exhaust pipes are disposed in front of the engine body and have exposed (i.e. not covered) front ends.

This configuration secures a space in front of the exhaust pipes, since there is not provided with any full cowl or the like covering the exhaust device from the front side thereof.

(j) In addition to the configuration (a), the collecting pipe is disposed at a position deviating to one side in a vehicle width direction from a center in the vehicle width direction, the individual exhaust pipes are disposed in front of the engine body, and the individual exhaust pipes each have a downstream portion covering the exhaust gas sensor from the front side thereof and slanting outward in the vehicle width direction toward an upper end.

The individual exhaust pipes efficiently cover the exhaust gas sensor disposed therebehind in this configuration. Furthermore, the exhaust gas sensor is easily disposed along the outer peripheral surface of the engine body.

(k) In addition to any one of the configurations (a) to (j), the engine body has a front surface provided with an oil filter protruding forward, the exhaust gas sensor is disposed at a position deviating to one side in the vehicle width direction from the oil filter, and the outward protrusion of the exhaust gas sensor slants to be away in the vehicle width direction from the oil filter toward the upper end.

The individual exhaust pipes extend apart from the oil filter in this configuration, to prevent interference between the oil filter and the individual exhaust pipes and facilitate attachment and detachment of the oil filter.

In summary, the present invention enables prevention of collision of foreign matter like sand or mud raised in front with the exhaust gas sensor without provision of any dedicated protective member such as a full cowl covering the exhaust device from the front side thereof. Furthermore, there is no need to consider foreign matter raised from a road surface as to positioning of the exhaust gas sensor, which accordingly has enhanced disposition flexibility.

DETAILED DESCRIPTION OF THE INVENTION

FIGS. 1 to 8 depict a motorcycle including an exhaust device according to the present invention. An embodiment of the present invention will now be described with reference to these figures. Assume in the present embodiment that a "left side" viewed from a rider on the motorcycle corresponds to a "side X1" in a vehicle width direction of a vehicle, an engine, and other equipment whereas a "right side" viewed from the rider corresponds to a "side X2" in the vehicle width direction of the vehicle, the engine, and the other equipment.

Figure 1:
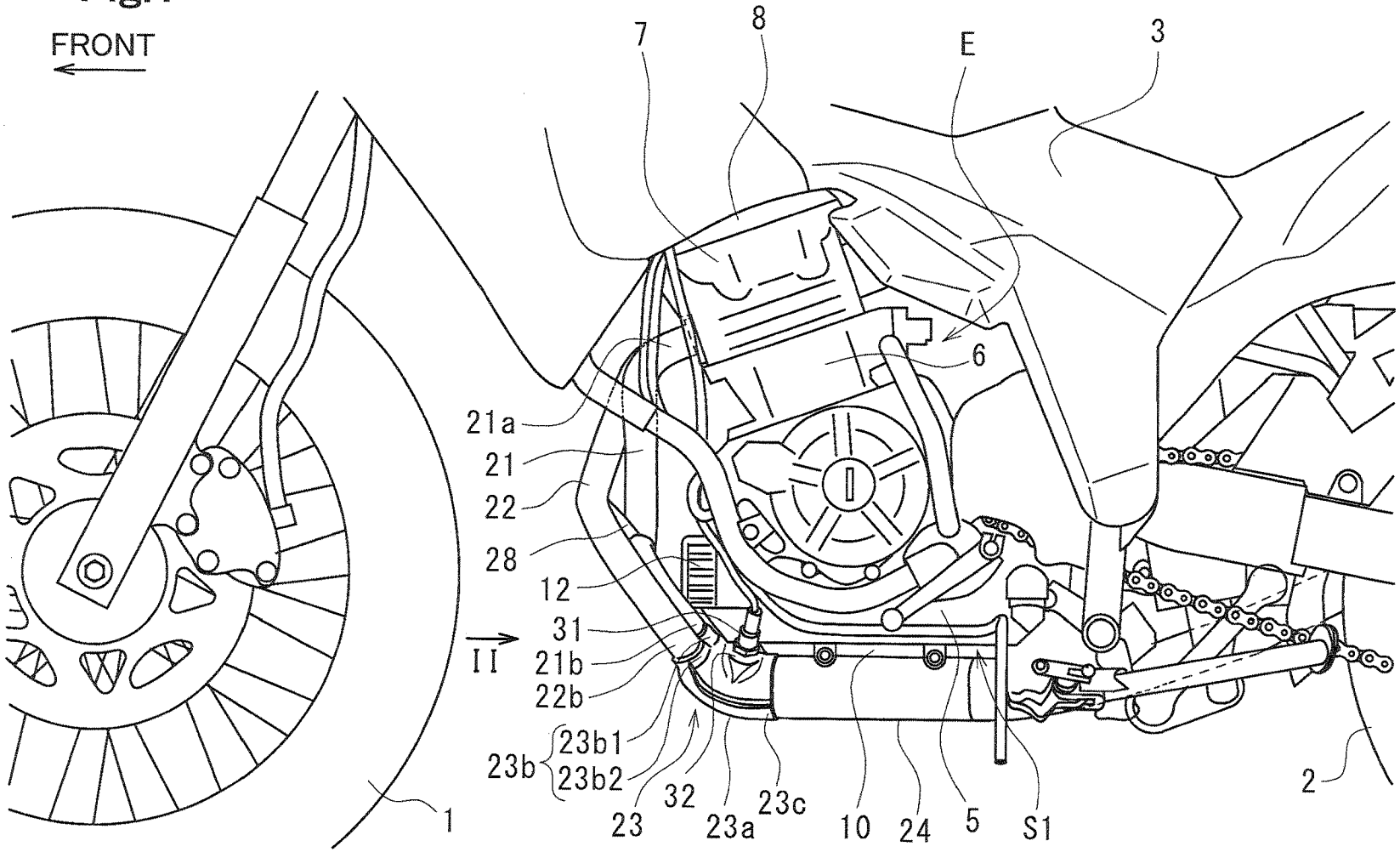
FIG. 1 is a left side view of a motorcycle including an exhaust device according to an embodiment of the present invention.

In FIG. 1, the motorcycle is equipped with an inline two-cylinder engine, and an engine body E is positioned between a front wheel 1 and a rear wheel 2 and is attached to a lower end of a main frame 3. The engine body E includes a crankcase 5, a cylinder block 6 coupled or provided integrally to a top portion of the crankcase 5, a cylinder head 7 coupled to a top portion of the cylinder block 6, a cylinder head cover 8 covering a top portion of the cylinder head 7, and an oil pan 10 coupled to the bottom of the crankcase 5. The cylinder head 7 is provided, at a front surface thereof, with left and right exhaust ports respectively in communication with the interior of the left and right cylinders, whereas the cylinder head 7 is provided, at a rear surface thereof, with left and right intake ports in communication with a throttle body and the like. The crankcase 5 has a front surface to which an oil filter 12 is detachably attached to protrude forward. The oil filter 12 is configured to purify oil supplied from the interior of the oil pan 10 to various portions in the engine.

Figure 2:
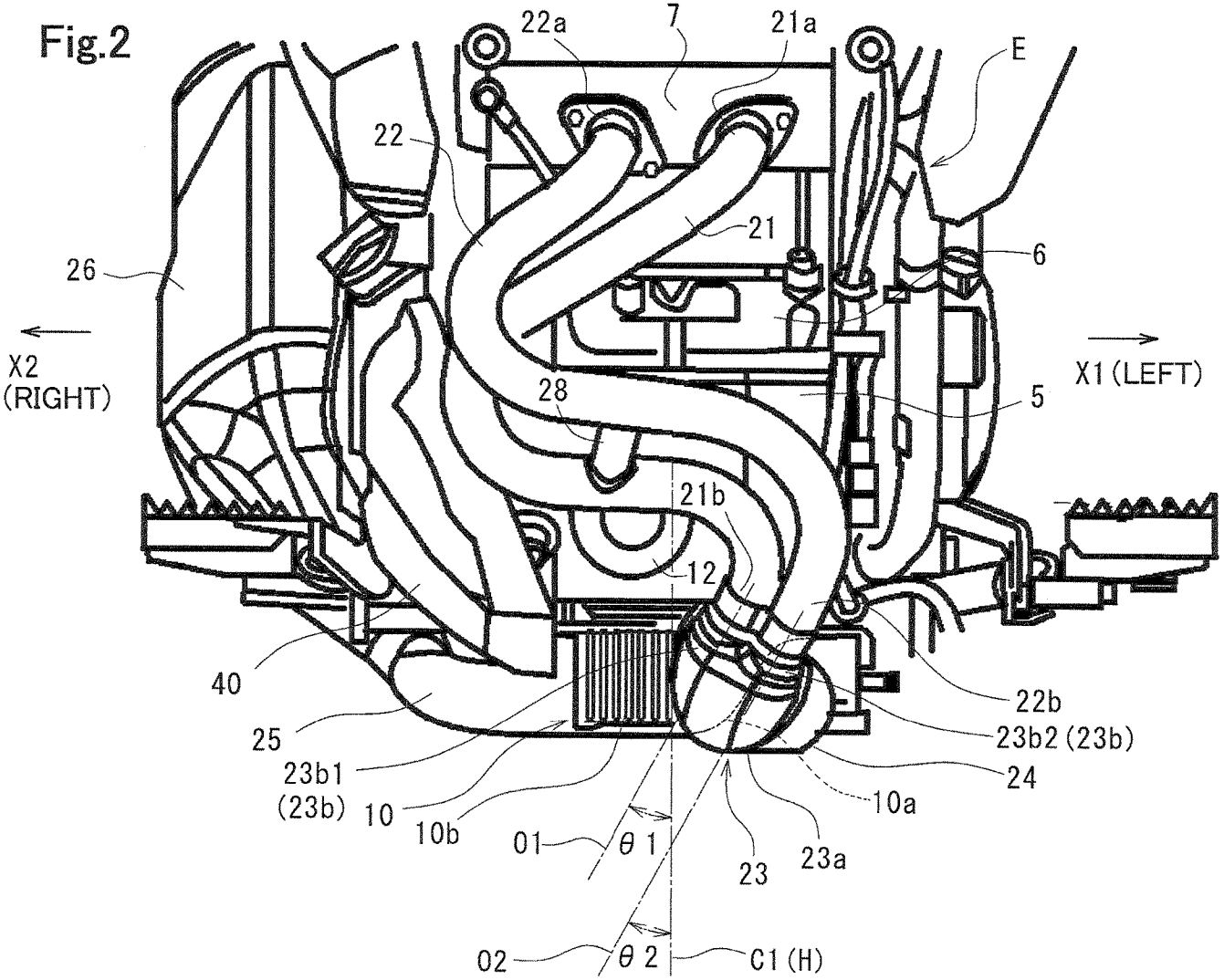
FIG. 2 is a front view (along an arrow II in FIG. 1) of the exhaust device depicted in FIG. 1.

The exhaust device according to the present application includes first and second individual exhaust pipes 21 and 22 disposed in front of the engine body E, a collecting pipe 23 disposed close to a lower front end of the engine body E, a catalyst pipe 24 disposed in a lower space S1 of the oil pan 10 and extending anteroposteriorly, a collecting exhaust pipe 25 disposed behind the oil pan 10 and extending backward across the vehicle from the side X1 in the vehicle width direction to the opposite side X2 in the vehicle width direction, as depicted in the front view of FIG. 2, and an exhaust muffler 26 connected to a rear end of the collecting exhaust pipe 25.

In FIG. 2, the first and second individual exhaust pipes 21 and 22 have upstream upper ends 21*a* and 22*a* connected to the left and right exhaust ports for the first and second cylinders of the cylinder head 7. The individual exhaust pipes 21 and 22 extend downward from the upper ends 21*a* and 22*a* while curving in substantially S shapes in a front view, and are connected to branched portions 23*b*1 and 23*b*2, respectively, of a bifurcated front portion 23*b* upstream of the collecting pipe 23. More specifically as to the S shapes, the individual exhaust pipes 21 and 22 deviate toward an end edge on the side X2 in the vehicle width direction of the engine body E while extending downward from the upper ends 21*a* and 22*a*, then curve in U shapes to the side X1 in the vehicle width direction, deviate toward an end edge on the side X1 in the vehicle width direction of the engine body E, and extend downward while deviating again to the side X2 in the vehicle width direction. In the course of forming the individual exhaust pipes 21 and 22 in the S shapes in a front view, the individual exhaust pipes 21 and 22 are overlapped with each other such that the second individual exhaust pipe 22 extends transversely in front of the first individual exhaust pipe 21 around the end edge in the side X2 in the vehicle width direction of the engine body E.

The individual exhaust pipes 21 and 22 have downstream lower end connections 21*b* and 22*b*, each of which has a straight cylindrical shape with a predetermined length. The lower end connections 21*b* and 22*b* have axial lines O1 and O2 slanting at specific angles θ1 and θ2 to the side X1 in the vehicle width direction from a vertical line H in a front view. The slant angles θ1 and θ2 are set to be substantially equal to each other. The individual exhaust pipes 21 and 22 are halfway made in communication with each other by a communication pipe 28 for uniformization and mitigation of left and right exhaust pulsation.

Figure 4:
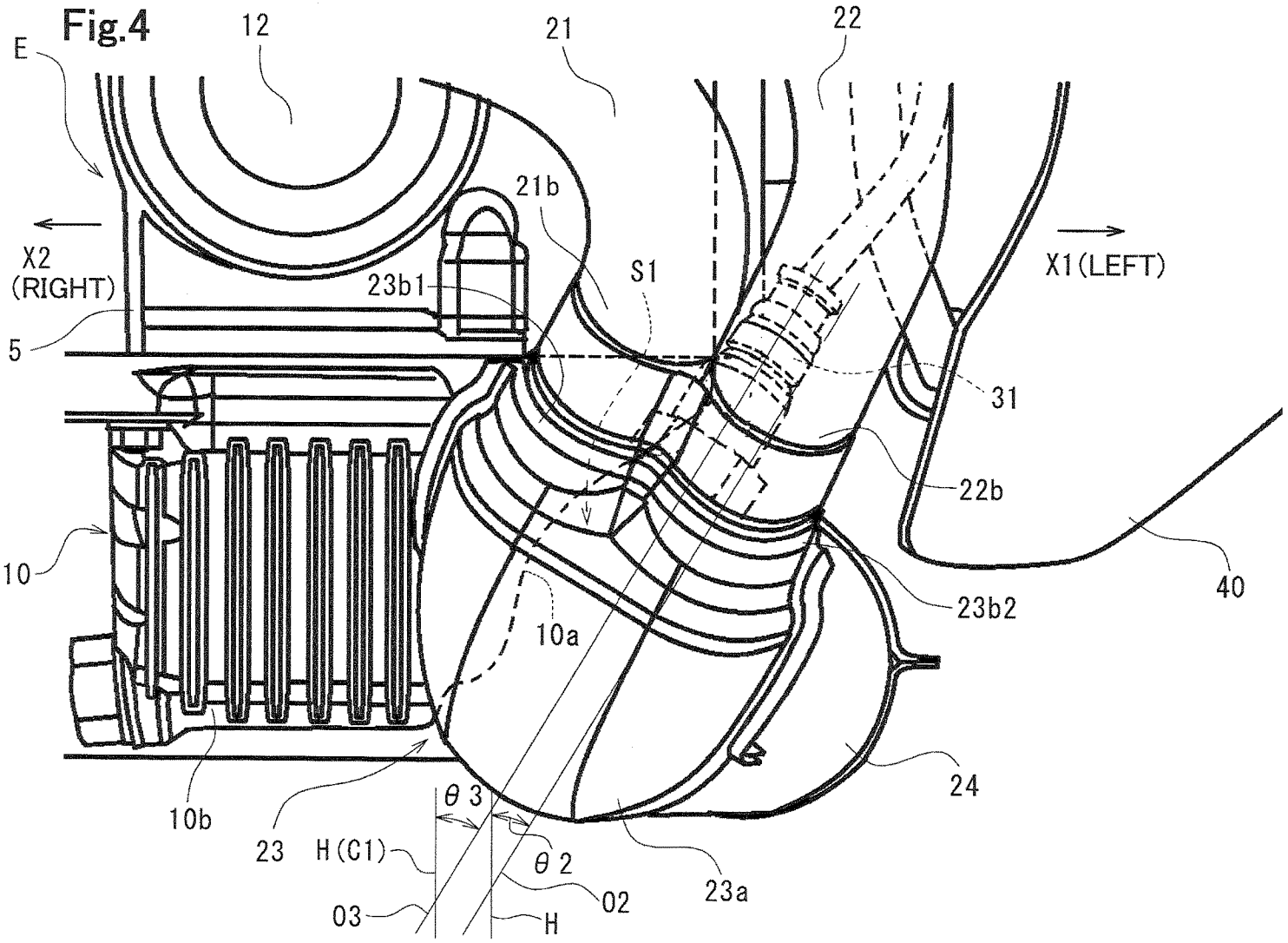
FIG. 4 is an enlarged front view of the lower portions of the individual exhaust pipes and the collecting pipe depicted in FIG. 1.

In FIG. 4, the oil pan 10 includes a shallow bottom portion 10*a* on the side X1 in the vehicle width direction with a shallow bottom and a deep bottom portion 10*b* on the side X2 in the vehicle width direction with a slanting lower surface protruding downward from the shallow bottom portion 10*a*. The lower space (recess portion) S1 is located below the shallow bottom portion 10*a*. This lower space S1 expands from the front end to the rear end of the oil pan 10. The lower space S1 accommodates the catalyst pipe 24 extending anteroposteriorly, and the collecting pipe 23 is disposed at a position substantially corresponding to the lower space S1 in a front view. The collecting pipe 23 and the catalyst pipe 24 are each disposed at a position deviating to the side X1 in the vehicle width direction from a vehicle width center line C1. The oil filter 12 is disposed above the deep bottom portion 10*b* of the oil pan 10 in a front view, at a position deviating to the side X2 in the vehicle width direction opposite to the collecting pipe 23 from the vehicle width center line C1.

Figure 3:
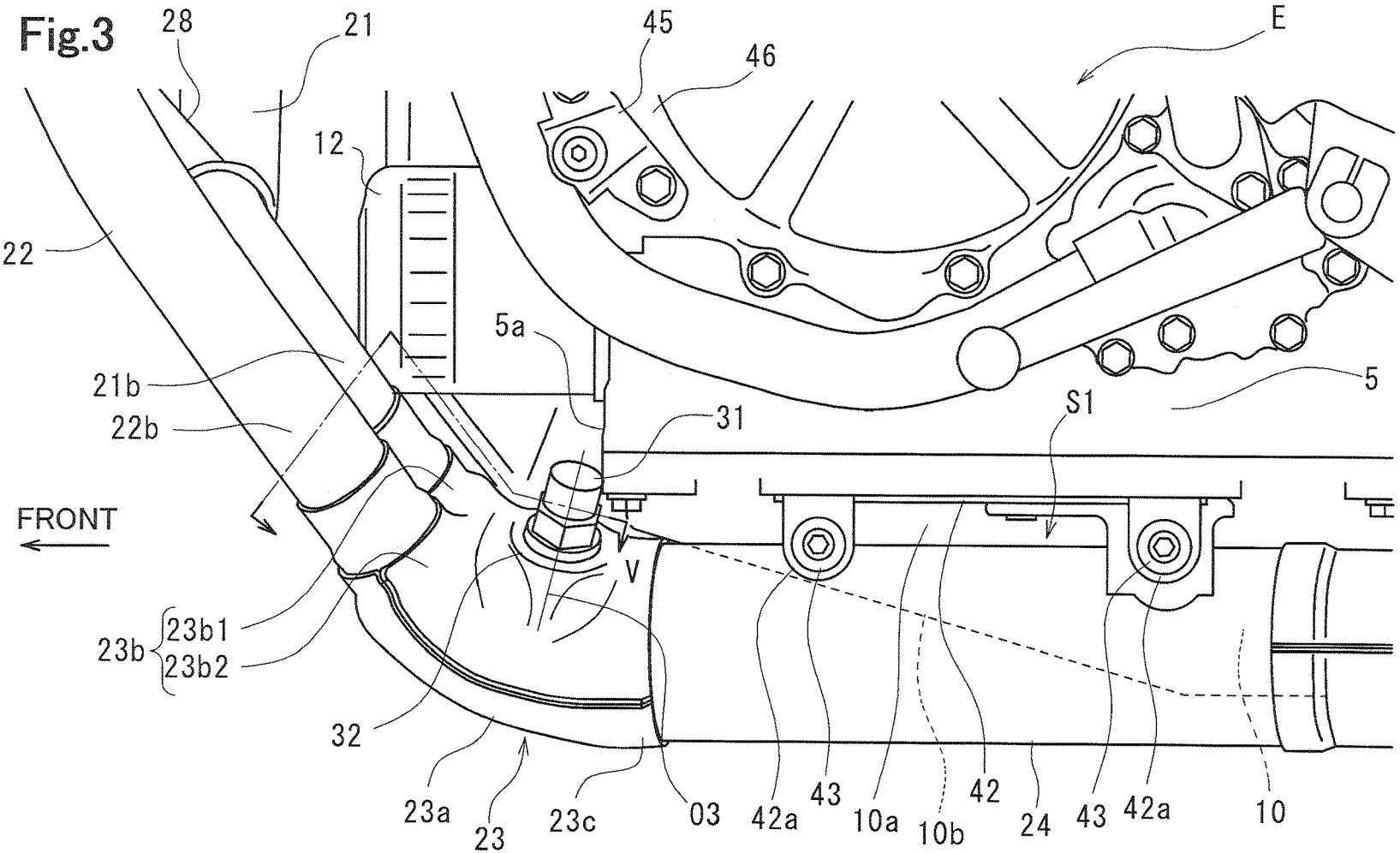
FIG. 3 is an enlarged left side view of lower portions of individual exhaust pipes, a collecting pipe, and a catalyst pipe depicted in FIG. 1.

In FIG. 3, the deep bottom portion 10*b* of the oil pan 10 has a bottom surface slanting downward from the front end to the rear end in a side view. The collecting pipe 23 is structured by coupling upper and lower halved cylindrical members, and includes a curved portion 23*a* having a curved shape rising forward, the bifurcated front portion 23*b* (23*b*1 and 23*b*2) extending upward and forward from a front end of the curved portion 23*a*, and a rear portion 23*c* extending backward from a rear end of the curved portion 23*a*. The collecting pipe 23 is structured by coupling the halved cylindrical members, so that the upper halved cylindrical member and the lower halved cylindrical member are each formed easily by press drawing a plate material. The branched portions 23*b*1 and 23*b*2 of the front portion 23*b* are fitted to the lower end connections 21*b* and 22*b* of the individual exhaust pipes 21 and 22 and are coupled thereto by welding, respectively. The rear portion 23*c* has a single cylindrical shape, is fitted to the front end of the catalyst pipe 24, and is coupled thereto by welding. The curved portion 23*a* and the front portion 23*b* bulge forward from the front end of the engine body E (the oil pan 10 and a front end surface 5*a* of the crankcase 5), whereas the rear portion 23*c* is positioned behind the front end of the engine body E and is accommodated in the lower space S1. The bifurcated front portion 23*b* slants from a horizontal plane such that the first branched portion 23*b*1 on the side X2 in the vehicle width direction is positioned higher than the second branched portion 23*b*2 on the side X1 in the vehicle width direction. The bifurcated front portion 23*b* is shaped such that the first branched portion 23*b*1 on the side X2 in the vehicle width direction is positioned slightly behind the second branched portion 23*b*2 on the side X1 in the vehicle width direction. The first branched portion 23*b*1 is connected with the lower end connection 21*b* of the first individual exhaust pipe 21 whereas the second branched portion 23*b*2 is connected with the lower end connection 22*b* of the second individual exhaust pipe 22. There is provided a recess between the first branched portion 23*b*1 and the second branched portion 23*b*2 of the front portion 23*b* such that the lower end connection 21*b* of the first individual exhaust pipe 21 and the lower end connection 22*b* of the second individual exhaust pipe 22 are connected smoothly to the first branched portion 23*b*1 and the second branched portion 23*b*2, respectively.

There is provided an exhaust gas sensor 31 exemplified by an oxygen sensor ($O_2$ sensor) configured to measure a concentration of oxygen in exhaust gas. The exhaust gas sensor 31 is detachably attached by screwing to an attachment boss 32 provided on a top surface of the curved portion 23*a* of the collecting pipe 23 so as to protrude radially outward. The attachment boss 32 is provided at a substantial center in the vehicle width direction of the curved portion 23*a*, close to a position where exhaust gas flowing from the branched portions 23*b*1 and 23*b*2 of the front portion 23*b* is collected. Assuming that a vehicle vertical direction corresponds to the vertical line, the attachment boss 32 and the exhaust gas sensor 31 have an axial line O3 slightly slanting backward from the vertical line.

The catalyst pipe 24 is provided therein with a catalyst converter. The catalyst converter has a honeycomb structure or the like. The catalyst converter includes a ceramic structure carrier that is coated with alumina and supports platinum, vanadium, and the like provided thereon as oxidation reaction catalysts.

As indicated in FIG. 4, the axial line O3 of an upward protrusion of the exhaust gas sensor 31 slants to the side X1 in the vehicle width direction from the vertical line H in a front view at an angle θ3 substantially equal to the slant angle θ2 at the lower end connection 22*b* of the second individual exhaust pipe 22. The upward protrusion of the exhaust gas sensor 31 is thus substantially entirely covered from the front side thereof with the lower end connection 22*b* of the second individual exhaust pipe 22 and the front portion 23*b* of the collecting pipe 23.

Figure 5:
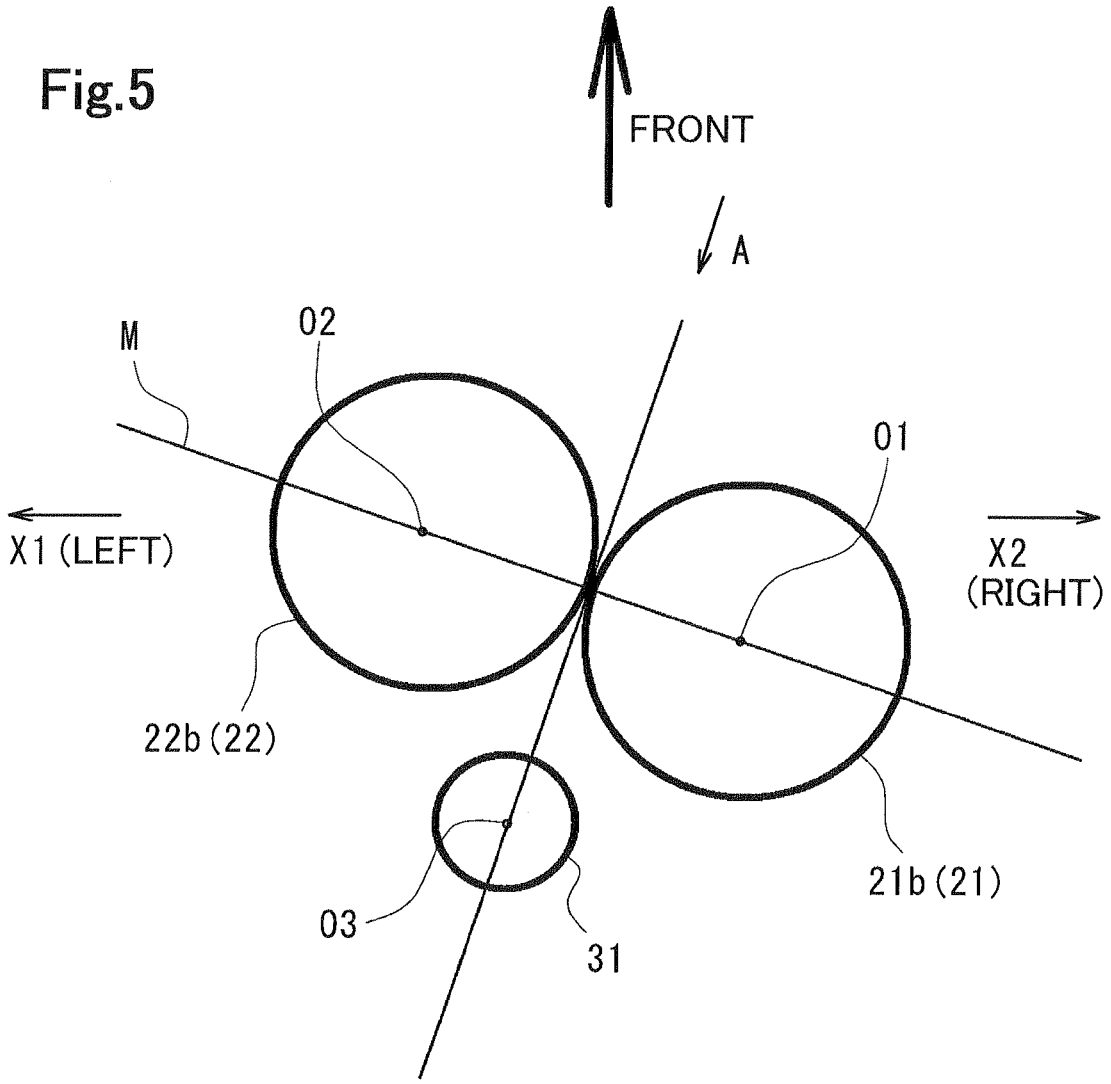
FIG. 5 is a schematic end view of the individual exhaust pipes and an exhaust gas sensor cut along a section V-V indicated in FIG. 3.

FIG. 5 is a sectional view taken along line V-V indicated in FIG. 3. The upward protrusion of the oxygen sensor 31 is disposed between the lower end connections 21*b* and 22*b* when viewed in a direction (indicated by an arrow A) perpendicular to a plane M including the axial lines O1 and O2 of the lower end connections 21*b* and 22*b* of the individual exhaust pipes 21 and 22.

Figure 6:
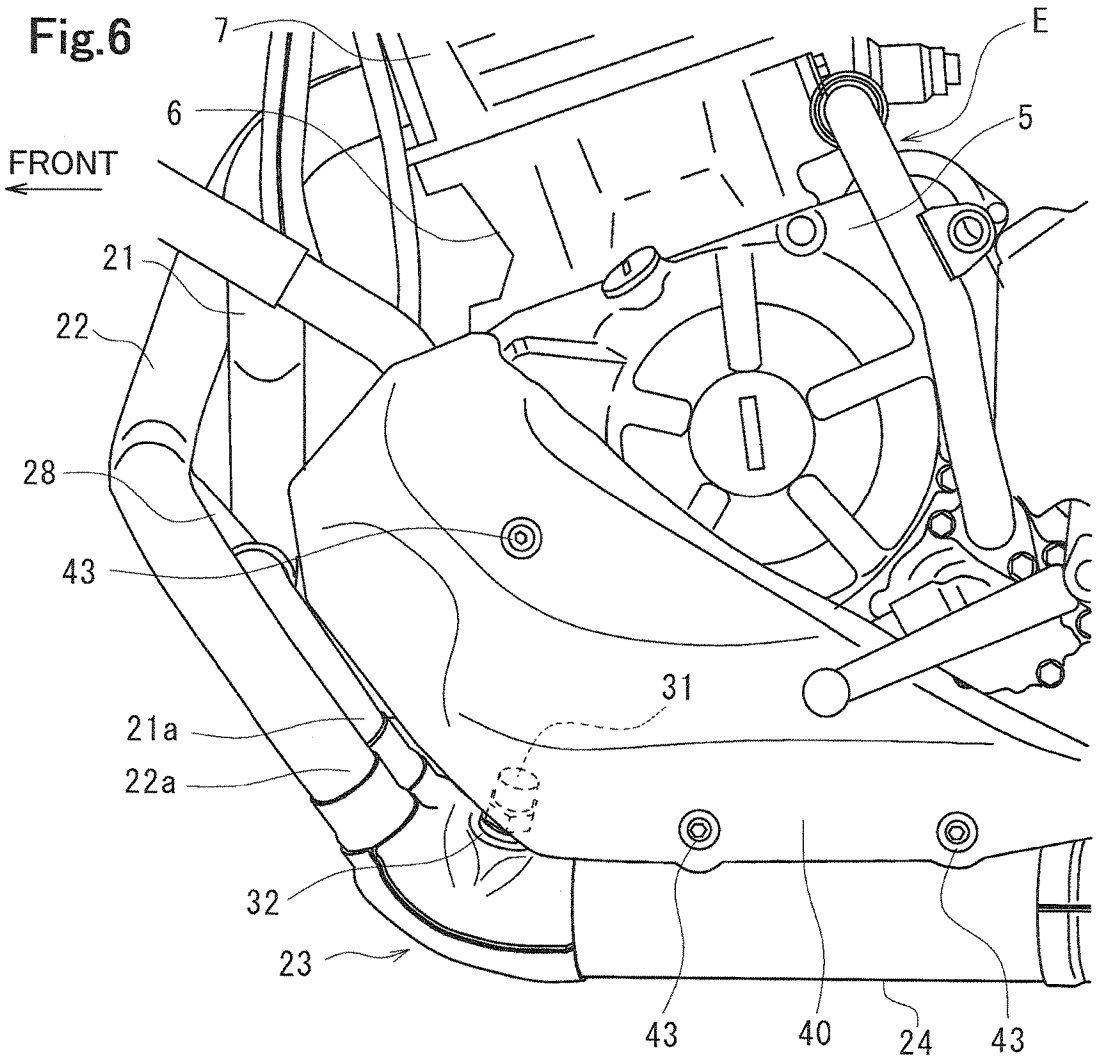
FIG. 6 is a left side view similar to FIG. 3, depicting a state where a side guard is attached.

In FIG. 6, according to the present embodiment, there is provided with a pair of side guards 40 covering the exhaust gas sensor 31 from a lateral sides thereof in the vehicle width direction. The side guard 40 covering the exhaust gas sensor 31 from the lateral side on the side X1 in the vehicle width direction is attached by bolts 43 to a side surface on the side X1 in the vehicle width direction of the engine body E at front and rear portions of a lower end and an upper front portion. As depicted in FIG. 3, the side guard 40 is attached by means of a lower attachment bracket 42 having a pair of front and rear bosses 42*a* and a front attachment bracket 45 fixed to the side surface on the side X1 in the vehicle width direction of the engine body E. The lower attachment bracket 42 is fastened to be fixed along with the oil pan 10 to a lower surface of the crankcase 5, whereas the front attachment bracket 45 is fixed to a generator cover 46.

Figure 7:
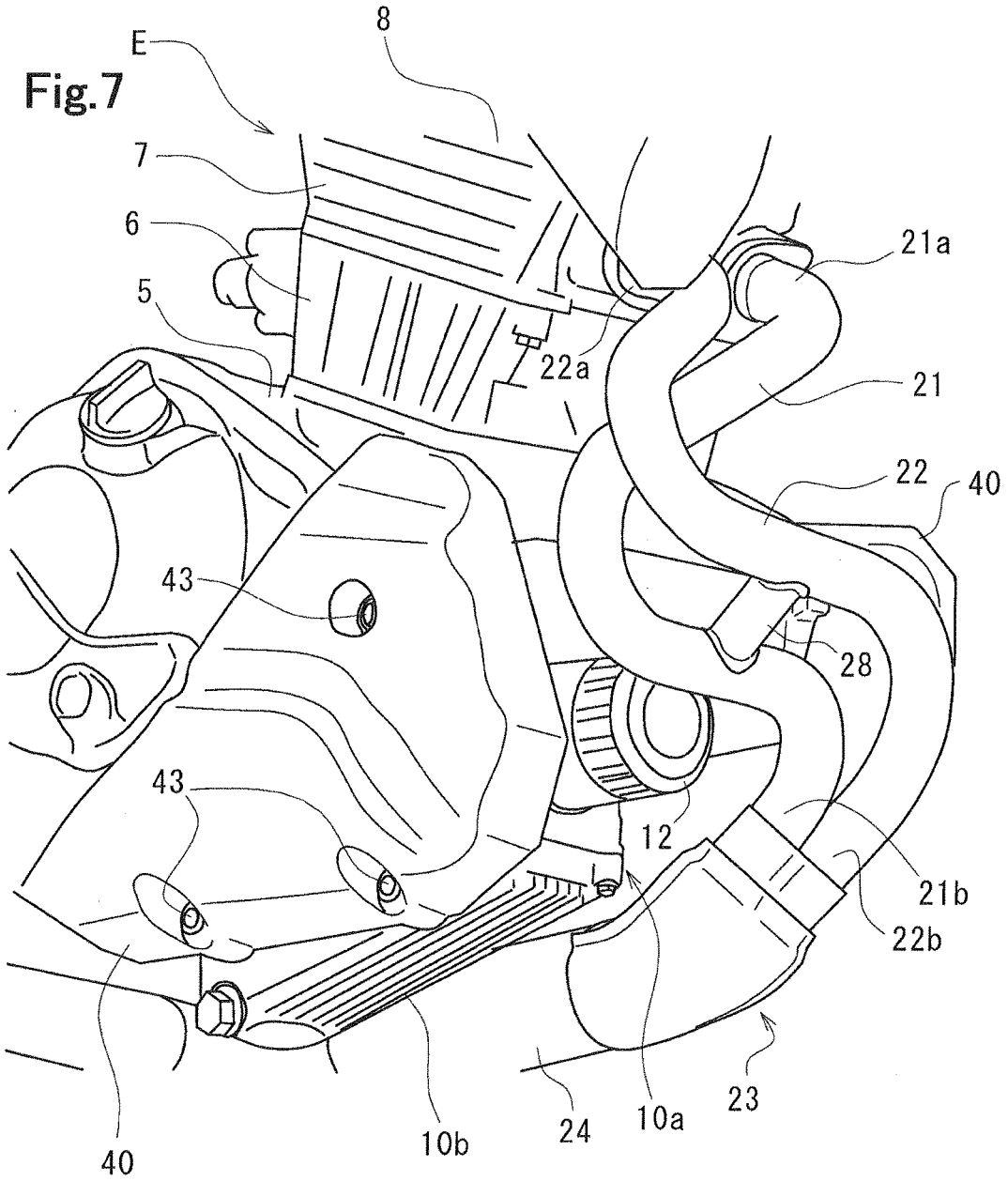
FIG. 7 is a perspective view from lower right in front of the exhaust device depicted in FIG. 1 in the state where the side guard is attached.

FIG. 7 depicts the side guard 40 disposed on the side X2 in the vehicle width direction of the engine body E, and is attached to the side surface on the side X2 in the vehicle width direction of the engine body E by means of bolts 43 at front and rear portions of a lower end and an upper front portion of the side guard 40 via attachment brackets, similarly to the side X1 in the vehicle width direction.

Figure 8:
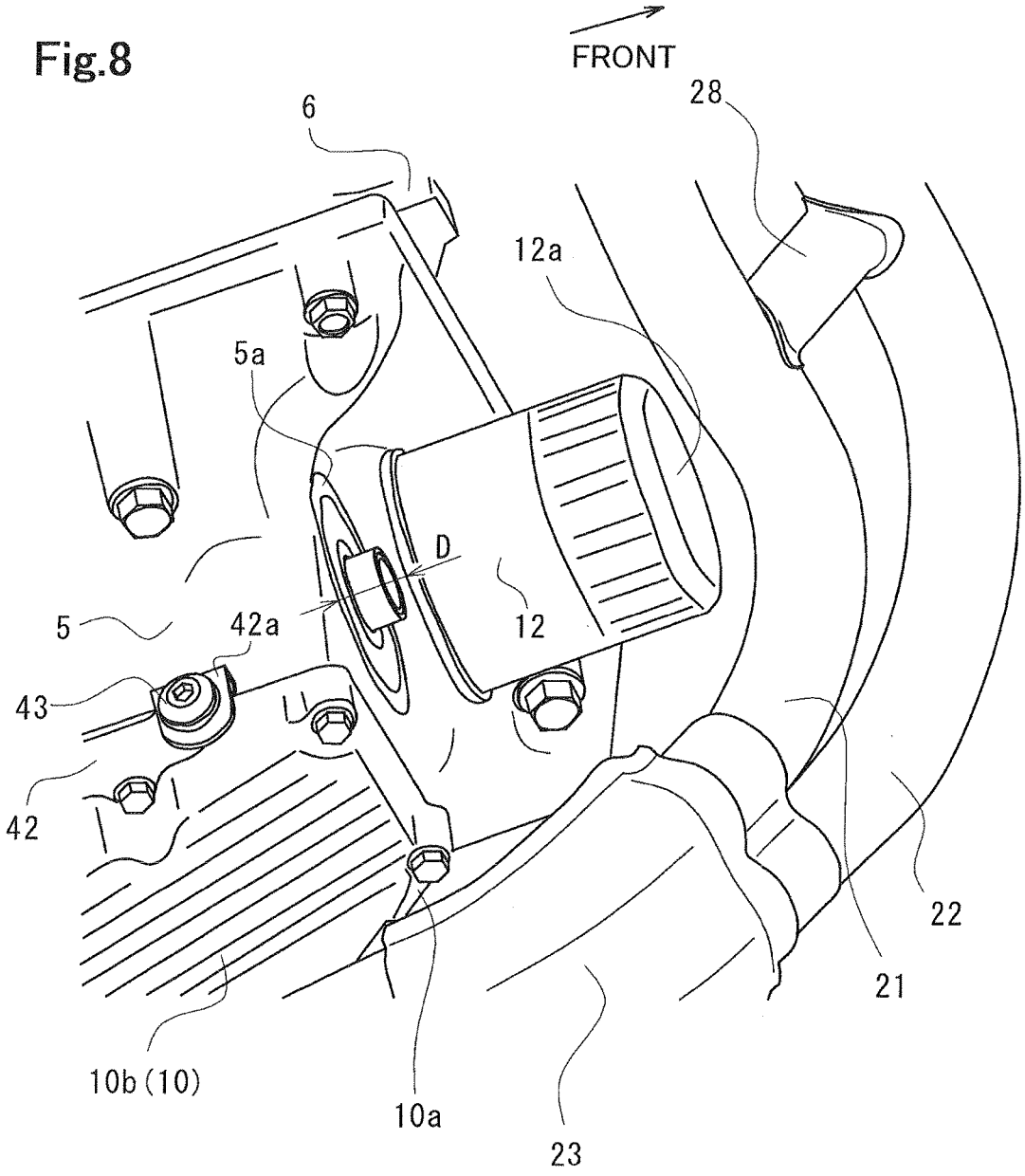
FIG. 8 is a perspective view similar to FIG. 7, depicting a state where an oil filter is detached.
Figure 9:
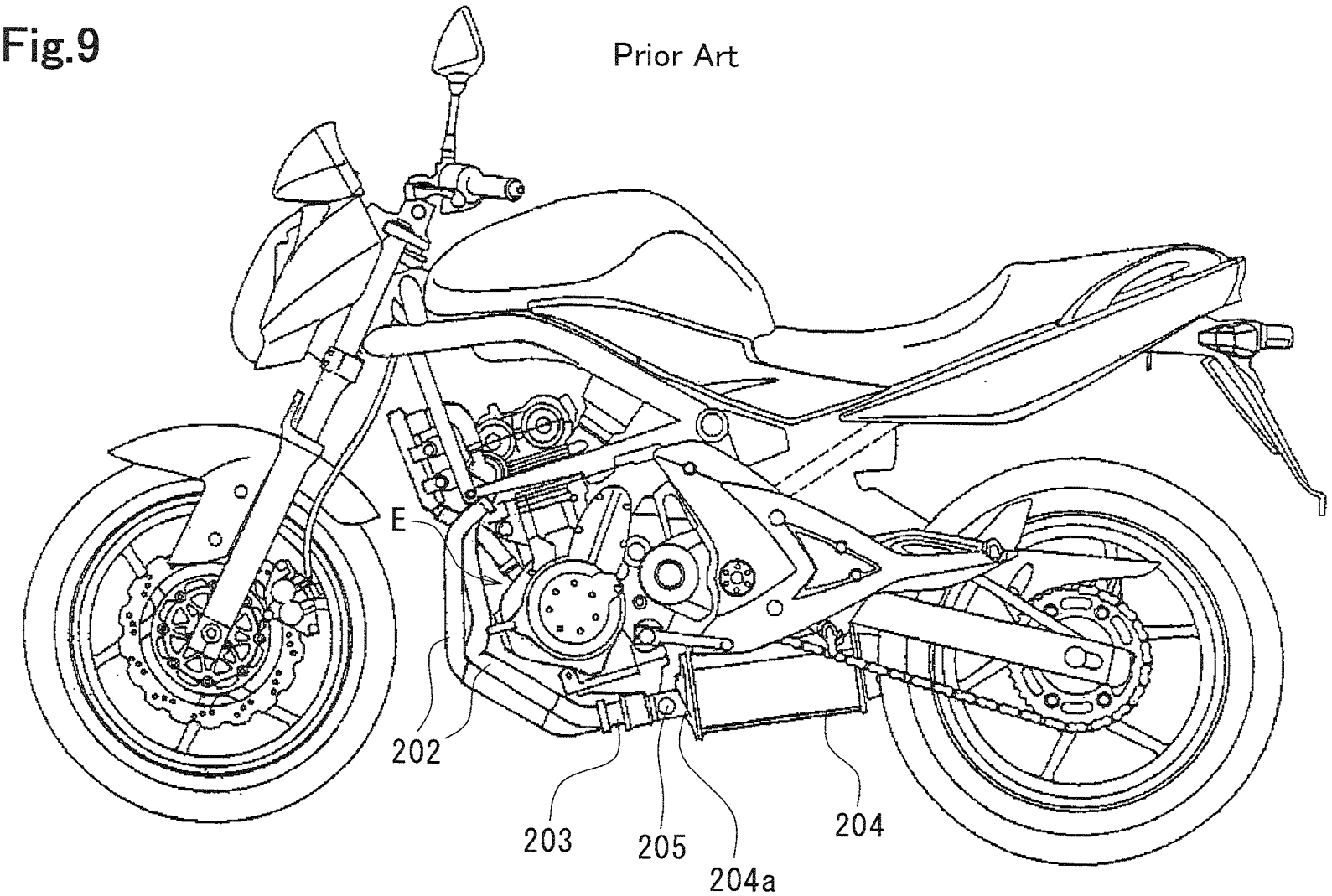
FIG. 9 is a left side view of a motorcycle, exemplifying a conventional exhaust device.

FIG. 8 depicts a state where the oil filter 12 is detached from the crankcase 5. The oil filter 12 is attached by screwing to the front end surface 5*a* of the crankcase 5. The oil filter 12 is configured to be detached from the crankcase 5 by moving forward by a specific detachment stroke D from an attached position and then moving laterally or downward. The first individual exhaust pipe 21 is partially overlapped with an upper end of the oil filter 12 in a front view. The first individual exhaust pipe 21 is disposed at a position antero-posteriorly away from a front end surface 12*a* of the oil filter 12 by a distance slightly longer than the detachment stroke D.

Effects of the Embodiment (1) Exhaust gas, which is discharged alternately from the left and right cylinders at intervals of 360 degrees or the like as a crank angle while the engine is in operation, flows in the individual exhaust pipes 21 and 22, is partially released to the other one of the individual exhaust pipes through the communication pipe 28 before flowing into the collecting pipe 23. The exhaust gas having flown into the collecting pipe 23 is collected near a collection position where the exhaust gas sensor 31 is disposed. The collected exhaust gas flows into the catalyst pipe 24 and is subject to an oxidation reaction promoting purification of HC and CO. The exhaust gas purified and heated is discharged outside through the collecting exhaust pipe 25 and the exhaust muffler 26.

(2) The exhaust gas sensor 31 is covered from the front side thereof with the lower end connections 21*b* and 22*b* of the individual exhaust pipes 21 and 22, so that foreign matter raised in front is prevented from colliding with the exhaust gas sensor 31 without provision of any dedicated protective member such as a full cowl (FIGS. 3 and 4).

(3) There is no need to consider foreign matter flying from ahead as to positioning of the exhaust gas sensor 31, which accordingly has enhanced positioning flexibility.

(4) The exhaust gas sensor 31 is disposed to protrude upward from the upper surface of the curved portion 23*a* curved upward and forward, so that the exhaust gas sensor 31 is protected from foreign matter flying from ahead by the lower end connections 21*b* and 22*b* of the individual exhaust pipes 21 and 22 as well as by the front portion 23*b* of the collecting pipe 23 (FIG. 3).

(5) The individual exhaust pipes 21 and 22 are each disposed to form an S shape in a front view so as to be overlapped with the oil filter 12 as less as possible and to keep an exhaust passage length. Furthermore, at a portion where the oil filter 12 and the individual exhaust pipe 21 are partially overlapped with each other, the individual exhaust pipe 21 and the front end surface 12*a* of the oil filter 12 are kept away from each other by a distance substantially corresponding to the forward detachment stroke D of the oil filter 12. This configuration allows the oil filter 12 to be detached with no need to detach the individual exhaust pipe 21 or 22, and also allows the individual exhaust pipes 21 and 22 to be disposed compactly close to the engine body E (FIG. 2).

(6) The exhaust gas sensor 31 in the exhaust device for the two-cylinder engine is disposed between the lower end connections 21*b* and 22*b* downstream of the two individual exhaust pipes 21 and 22, specifically, between the connections 21*b* and 22*b* when viewed in a direction (indicated by the arrow A) perpendicular to the plane M including the axial lines O1 and O2 of the connections 21*b* and 22*b*. The individual exhaust pipes 21 and 22 thus cover a wide range of the exhaust gas sensor 31 (FIG. 5).

(7) The front end of the collecting pipe 23 is positioned higher than the sensor attachment boss 32 provided on the upper surface of the collecting pipe 23, to prevent foreign matter flying from ahead from colliding with a root portion of the exhaust gas sensor 31 (FIG. 3).

(8) The exhaust gas sensor 31 extends upward to slant to the side X1 in the vehicle width direction at the specific angle θ3 from the vertical line H in a front view. The lower end connection 22*b* of the second individual exhaust pipe 22 covering the exhaust gas sensor 31 from the front side thereof also slants to the same side as the exhaust gas sensor 31 at the substantially equal angle θ2. This configuration allows a projected area of the second individual exhaust pipe 22 from ahead to be efficiently utilized for protection of the exhaust gas sensor 31 (FIG. 4).

(9) The collecting pipe 23 is disposed to deviate to one of the sides (the side X1) in the vehicle width direction from the vehicle width center line C1, and the upward protrusion of the exhaust gas sensor 31 from the collecting pipe 23 slants outward in the vehicle width direction so as to lean to the deviation side (the side X1). The exhaust gas sensor 31 is thus easily disposed along the outer peripheral shape of the engine body E. The exhaust gas sensor 31 is disposed compactly close to the engine body E, and the oil filter 12 protruding from the front surface of the engine body E is easily prevented from interfering with the exhaust gas sensor 31 (FIG. 4).

(10) The collecting pipe 23 is disposed at the lower front end of the engine body E and the catalyst pipe 24 subsequently connected directly to the collecting pipe 23 is disposed in the lower space S1 of the oil pan 10. The catalyst pipe 24 is thus disposed close to the exhaust ports of the cylinder head 7 for improvement in catalytic action (FIG. 3).

(11) The exhaust gas sensor 31 provided on the collecting pipe 23 is disposed in front of the oil pan 10 and the crankcase 5 of the engine body E, and the rear portion 23*c* of the collecting pipe 23 is disposed below the shallow bottom portion 10*a* of the oil pan 10. Accordingly, the exhaust gas sensor 31 and the engine body E are prevented from interfering with each other and the collecting pipe 23 is easily disposed close to the engine body E (FIG. 3).

(12) The catalyst pipe 24 and the collecting pipe 23 are disposed below the oil pan 10 and substantially within the vehicle width of the engine body E. Accordingly, the exhaust gas sensor 31 is prevented from interfering with lateral parts and the motorcycle can have large left and right bank angles (FIG. 2).

(13) The side guards 40 are provided to cover the exhaust gas sensor 31 from the lateral sides, to prevent foreign matter flying from outside in the vehicle width direction from colliding with the exhaust gas sensor 31 (FIGS. 4, 6, and 7).

(14) The oil filter 12 provided to protrude forward from the front end surface 5*a* of the crankcase 5 deviates to one of the sides (the side X2) in the vehicle width direction, the exhaust gas sensor 31 deviates to the side (the side X1) in the vehicle width direction opposite from the oil filter, and the exhaust gas sensor 31 slants to be away from the oil filter 12 toward the upper end. Accordingly, the individual exhaust pipes 21 and 22 are disposed to be away from the oil filter 12, to prevent interference between the oil filter 12 and the individual exhaust pipes 21 and 22 and facilitate detachment of the oil filter 12 (FIG. 2).

(15) The individual exhaust pipes 21 and 22 are provided thereahead with no dedicated protective member such as a full cowl, to keep a large space ahead of the individual exhaust pipes 21 and 22. The individual exhaust pipes 21 and 22 and the collecting pipe 23 are thus prevented from interfering with any stepped portion of a ground surface when the vehicle travels over the stepped portion.

(16) The collecting pipe 23 provided separately from the individual exhaust pipes 21 and 22 has the shape curved upward and forward, and is structured by coupling the upper and lower halved cylindrical members. The collecting pipe 23 is produced to have a reduced anteroposterior size in comparison to a collecting pipe produced using a pipe member. The catalyst pipe 24 provided behind the collecting pipe 23 is thus disposed ahead as much as possible. This configuration improves catalyst temperature rise performance at the catalyst pipe 24. The collecting pipe produced using a pipe member is difficult to be disposed ahead due to a chuck space kept for bending and limitation in radius of curvature for the bending.

(17) The two individual exhaust pipes 21 and 22 are halfway made in communication with each other by the communication pipe 28 for uniformization and mitigation of exhaust pulsation of the cylinders as well as for improvement in rigidity of the entire exhaust pipes.

Other Embodiments (1) Examples of the exhaust gas sensor include, in addition to the oxygen sensor configured to measure an oxygen concentration, sensors configured to detect various properties of exhaust gas, such as an exhaust temperature sensor.

(2) The embodiment described above relates to the exhaust device for the two-cylinder engine. This embodiment is also applicable to an exhaust device for a single cylinder engine or a multiple cylinder engine including three or more cylinders.

(3) The exhaust device alternatively includes no side guard.

(4) The vehicle is not limited to a motorcycle. The above embodiment is applicable to an exhaust device for a saddled four-wheel travelling vehicle, a multi-purpose four-wheel travelling vehicle, and the like.

(5) The front portion of the collecting pipe is alternatively extended upward to cover the exhaust gas sensor from the front side thereof with only the front portion of the collecting pipe.

What is claimed is:

1. A vehicle exhaust device comprising:

a plurality of exhaust passage forming units forming an exhaust passage from at least one exhaust port provided at an engine body to an exhaust muffler provided behind the engine body; and an exhaust gas sensor attached to a portion of the exhaust passage forming units halfway on the exhaust passage, wherein at least a portion of the exhaust gas sensor is covered from a front side thereof with the portion of the exhaust passage forming units upstream of an attached position of the exhaust gas sensor, the engine body includes a crankcase, and the exhaust gas sensor is disposed in front of a front surface of the crankcase, a forward direction of the vehicle corresponding to a front direction of the vehicle exhaust device, wherein the portion of the exhaust passage forming units upstream of an attached position of the exhaust gas sensor extends in an extending direction of the exhaust gas sensor in a front view.

2. The vehicle exhaust device according to claim 1, wherein the engine body includes a plurality of cylinders, the plurality of exhaust passage forming units includes a plurality of individual exhaust pipes connected respectively to the exhaust ports of the cylinders and a collecting pipe collecting downstream ends of the plurality of individual exhaust pipes, and the exhaust gas sensor is attached to the collecting pipe.

3. The vehicle exhaust device according to claim 2, wherein the plurality of individual exhaust pipes includes two pipes, each pipe having downstream connections disposed in parallel with each other, and the exhaust gas sensor is positioned between the two connections when viewed in a direction perpendicular to a plane including axial lines of the connections.

4. The vehicle exhaust device according to claim 2, wherein the collecting pipe has a front end connected to lower ends of the individual exhaust pipes and positioned above the attached position of the exhaust gas sensor.

5. The vehicle exhaust device according to claim 2, wherein the collecting pipe includes:

a downstream rear portion disposed close to a lower front end of the engine body and provided anteroposteriorly;

a curved portion connected to a front end of the rear portion and curved upward; and an upstream front portion extending from an upper end of the curved portion to the lower ends of the individual exhaust pipes.

6. The vehicle exhaust device according to claim 2, wherein the exhaust gas sensor protrudes radially outward from the collecting pipe, the downstream connections of the individual exhaust pipes covering the exhaust gas sensor from the front side thereof extend in an extending direction of the exhaust gas sensor in a front view.

7. The vehicle exhaust device according to claim 2, wherein the collecting pipe is disposed at a position deviating to one side in a vehicle width direction from a center in the vehicle width direction, and the outward protrusion of the exhaust gas sensor slants outward in the vehicle width direction toward an upper end.

8. The vehicle exhaust device according to claim 2, wherein the exhaust gas sensor is disposed in front of the engine body, and the rear portion of the collecting pipe is disposed below the engine body.

9. The vehicle exhaust device according to claim 2, further comprising:

a guard covering the exhaust gas sensor from a lateral side thereof in the vehicle width direction.

10. The vehicle exhaust device according to claim 2, wherein the individual exhaust pipes are disposed in front of the engine body and have exposed front ends.

11. The vehicle exhaust device according to claim 2, wherein the collecting pipe is disposed at a position deviating to one side in a vehicle width direction from a center in the vehicle width direction, the individual exhaust pipes are disposed in front of the engine body, and the individual exhaust pipes each have a downstream portion covering the exhaust gas sensor from the front side thereof and slanting outward in the vehicle width direction toward an upper end.

12. The vehicle exhaust device according to claim 2, wherein the exhaust gas sensor is detachably connected by screwing to an attachment portion provided on the collecting pipe.

13. The vehicle exhaust device according to claim 2, wherein the exhaust gas sensor and a lower end connection of the individual exhaust pipe extend upward to slant in the vehicle width direction at substantially a same angle in a front view.

14. The vehicle exhaust device according to claim 2, wherein a front portion of the collecting pipe covers the exhaust gas sensor from the front side thereof.

15. The vehicle exhaust device according to claim 1, wherein the engine body has a front surface provided with an oil filter protruding forward, the exhaust gas sensor is disposed at a position deviating to one side in the vehicle width direction from the oil filter, and the outward protrusion of the exhaust gas sensor slants away in the vehicle width direction from the oil filter toward the upper end.

16. The vehicle exhaust device according to claim 1, wherein the exhaust gas sensor is entirely covered from a front side thereof with the portion of the exhaust passage forming units upstream of an attached position of the exhaust gas sensor.

17. A vehicle exhaust device comprising:

a plurality of exhaust passage forming units forming an exhaust passage from at least one exhaust port provided at an engine body to an exhaust muffler provided behind the engine body; and an exhaust gas sensor attached to a portion of the exhaust passage forming units halfway on the exhaust passage, wherein the exhaust gas sensor is entirely covered from a front side thereof with the portion of the exhaust passage forming units upstream of an attached position of the exhaust gas sensor, a forward direction of the vehicle corresponding to a front direction of the vehicle exhaust device.

* * * * *